US005746354A

United States Patent [19]

Perkins

[11] Patent Number: 5,746,354

[45] Date of Patent: May 5, 1998

[54] MULTI-COMPARTMENT AEROSOL SPRAY CONTAINER

[76] Inventor: Gary W. Perkins, 30555 N. Walker Rd., Walker, La. 70785

[21] Appl. No.: 736,124

[22] Filed: Oct. 24, 1996

[51] Int. Cl.[6] ..... B67D 5/60

[52] U.S. Cl. ..... 222/132; 222/135; 222/153.11

[58] Field of Search ..... 222/129, 132, 222/135, 144.5, 153.11, 330, 402.1, 402.11

[56] References Cited

U.S. PATENT DOCUMENTS 3,211,343 10/1965 Silver ..... 222/144.5
3,814,298 6/1974 Hansen ..... 222/153.11

FOREIGN PATENT DOCUMENTS 3142205 5/1983 Germany ..... 222/144.5

*Primary Examiner*—Philippe Derakshani

[57] ABSTRACT

A new Multi-Compartment Aerosol Spray Container for providing various colors of paint from within one convenient aerosol can, thereby decreasing painting time and environmental waste. The inventive device includes an aerosol can having a plurality of vertical partitions which define a plurality of compartments, a corresponding plurality of spray nozzles coupled to the compartments, and a horizontal passage projecting through the plurality of spray nozzles which receives a pin thereby horizontally coupling the plurality of spray nozzles together.

6 Claims, 3 Drawing Sheets

MULTI-COMPARTMENT AEROSOL SPRAY CONTAINER

BACKGROUND OF THE INVENTION

1. Field of the Invention

The present invention relates to Aerosol Spray Devices and more particularly pertains to a new Multi-Compartment Aerosol Spray Container for providing various colors of paint from within one convenient aerosol can, thereby decreasing painting time and environmental waste.

2. Description of the Prior Art

The use of Aerosol Spray Devices is known in the prior art. More specifically, Aerosol Spray Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Aerosol Spray Devices include U.S. Pat. No. 5,411,187; U.S. Pat. No. 5,390,830; U.S. Pat. No. 5,131,569; U.S. Pat. No. 3,977,576; U.S. Pat. No. 4,013,231 and U.S. Design Pat. No. 299,810.

While these devices fulfill their respective, particular objectives and requirements, the aforementioned patents do not disclose a new Multi-Compartment Aerosol Spray Container. The inventive device includes an aerosol can having a plurality of vertical partitions which define a plurality of compartments, a corresponding plurality of spray nozzles coupled to the compartments, and a horizontal passage projecting through the plurality of spray nozzles which receives a pin thereby horizontally coupling the plurality of spray nozzles together.

In these respects, the Multi-Compartment Aerosol Spray Container according to the present invention substantially departs from the conventional concepts and designs of the prior art, and in so doing provides an apparatus primarily developed for the purpose of providing various colors of paint from within one convenient aerosol can, thereby decreasing painting time and environmental waste.

SUMMARY OF THE INVENTION

In view of the foregoing disadvantages inherent in the known types of Aerosol Spray Devices now present in the prior art, the present invention provides a new Multi-Compartment Aerosol Spray Container construction wherein the same can be utilized for providing various colors of paint from within one convenient aerosol can, thereby decreasing painting time and environmental waste.

The general purpose of the present invention, which will be described subsequently in greater detail, is to provide a new Multi-Compartment Aerosol Spray Container apparatus and method which has many of the advantages of the Aerosol Spray Devices mentioned heretofore and many novel features that result in a new Multi-Compartment Aerosol Spray Container which is not anticipated, rendered obvious, suggested, or even implied by any of the prior art Aerosol Spray Devices, either alone or in any combination thereof.

To attain this, the present invention generally comprises an aerosol can having a plurality of vertical partitions which define a plurality of compartments, a corresponding plurality of spray nozzles coupled to the compartments, and a horizontal passage projecting through the plurality of spray nozzles which receives a pin thereby horizontally coupling the plurality of spray nozzles together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Multi-Compartment Aerosol Spray Container apparatus and method which has many of the advantages of the Aerosol Spray Devices mentioned heretofore and many novel features that result in a new Multi-Compartment Aerosol Spray Container which is not anticipated, rendered obvious, suggested, or even implied by any of the prior art Aerosol Spray Devices, either alone or in any combination thereof.

It is another object of the present invention to provide a new Multi-Compartment Aerosol Spray Container which may be easily and efficiently manufactured and marketed.

It is a further object of the present invention to provide a new Multi-Compartment Aerosol Spray Container which is of a durable and reliable construction.

An even further object of the present invention is to provide a new Multi-Compartment Aerosol Spray Container which is susceptible of a low cost of manufacture with regard to both materials and labor, and which accordingly is then susceptible of low prices of sale to the consuming public, thereby making such Multi-Compartment Aerosol Spray Container economically available to the buying public.

Still yet another object of the present invention is to provide a new Multi-Compartment Aerosol Spray Container which provides in the apparatuses and methods of the prior art some of the advantages thereof, while simultaneously overcoming some of the disadvantages normally associated therewith.

Still another object of the present invention is to provide a new Multi-Compartment Aerosol Spray Container for providing various colors of paint from within one convenient aerosol can, thereby decreasing painting time and environmental waste.

Yet another object of the present invention is to provide a new Multi-Compartment Aerosol Spray Container which includes an aerosol can having a plurality of vertical partitions which define a plurality of compartments, a corresponding plurality of spray nozzles coupled to the compartments, and a horizontal passage projecting through the plurality of spray nozzles which receives a pin thereby horizontally coupling the plurality of spray nozzles together.

Still yet another object of the present invention is to provide a new Multi-Compartment Aerosol Spray Container that decreases the number of aerosol cans that a user has in storage.

Even still another object of the present invention is to provide a new Multi-Compartment Aerosol Spray Container that is especially useful in painting multi-colored designs such as camouflage patterns.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
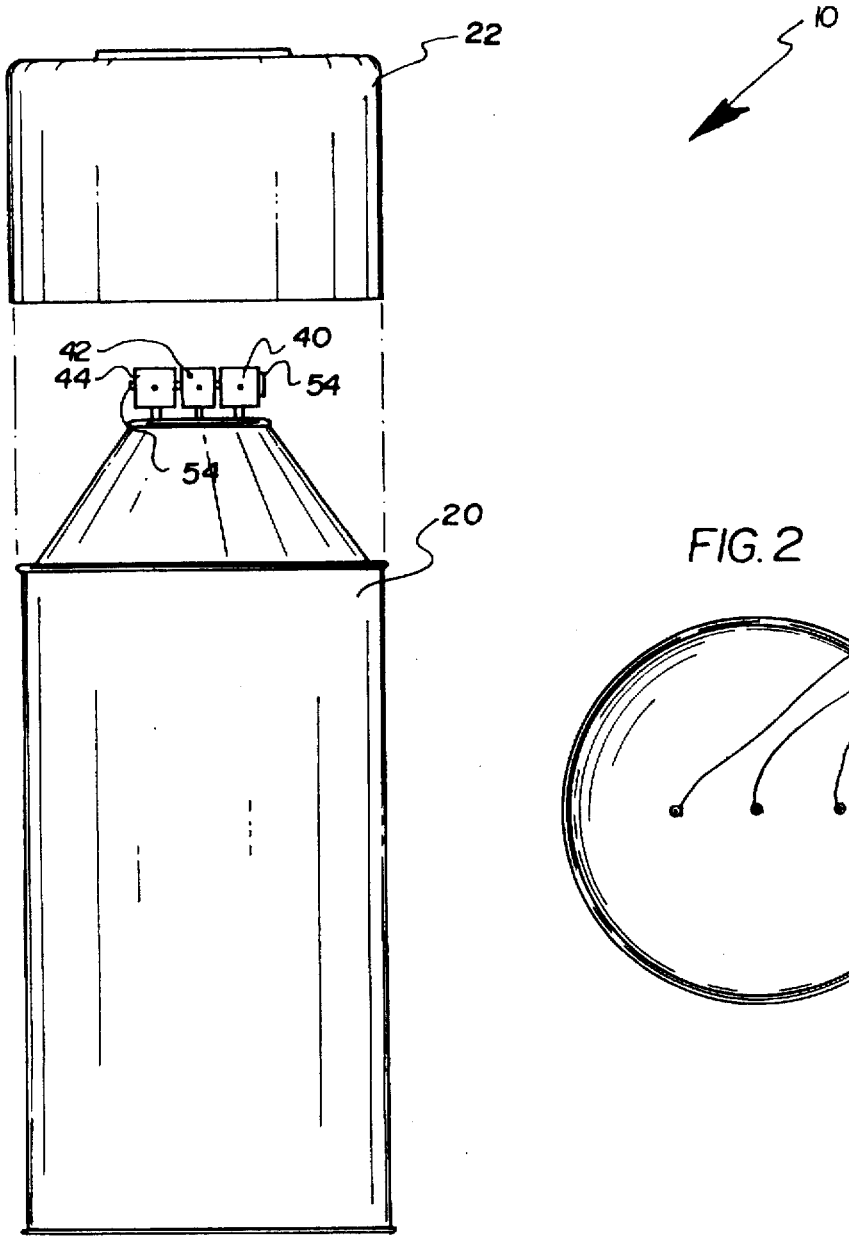
FIG. 1 is a front view of a new Multi-Compartment Aerosol Spray Container according to the present invention.

With reference now to the drawings, and in particular to FIGS. 1 through 6 thereof, a new Multi-Compartment Aerosol Spray Container embodying the principles and concepts of the present invention and generally designated by the reference numeral 10 will be described.

More specifically, it will be noted that the Multi-Compartment Aerosol Spray Container 10 comprises an aerosol can 20 having a plurality of vertical partitions which define a plurality of compartments, a corresponding plurality of spray nozzles coupled to the compartments, and a horizontal passage 52 projecting through the plurality of spray nozzles which receives a pin 54 thereby horizontally coupling the plurality of spray nozzles together.

As best illustrated in FIGS. 1 through 6, it can be shown that the aerosol can 20 has a first partition 24 and a second partition 26 substantially parallel to the first partition 24 thereby forming a first compartment 30, a second compartment 32 and a third compartment 34. The compartments preferably store under pressure a desired color of paint which the user may later dispense. A first spray nozzle 40 couples to the aerosol can 20 projecting into the first compartment 30. A second spray nozzle 42 couples to the aerosol can 20 projecting into the second compartment 32. A third spray nozzle 44 coupling to the aerosol can 20 projecting into the third compartment 34, where the spray nozzles 40, 42, 44 are aligned to form a vertical plane.

Figure 5:
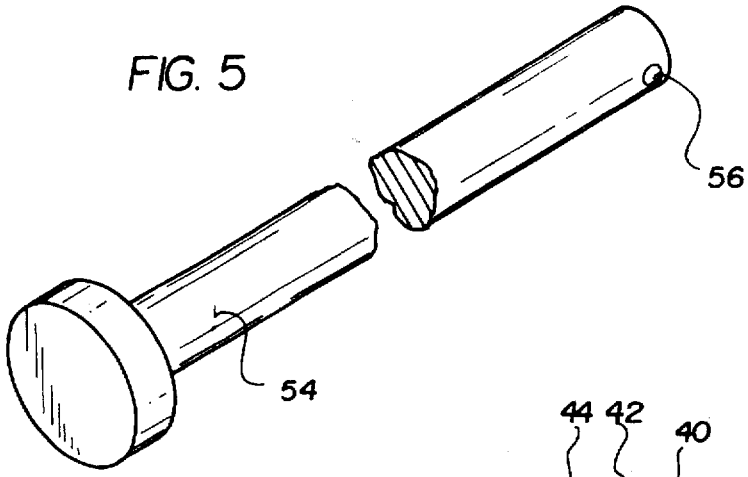
FIG. 5 is an upper perspective view of the pin which removably couples the plurality of spray nozzles.
Figure 6:
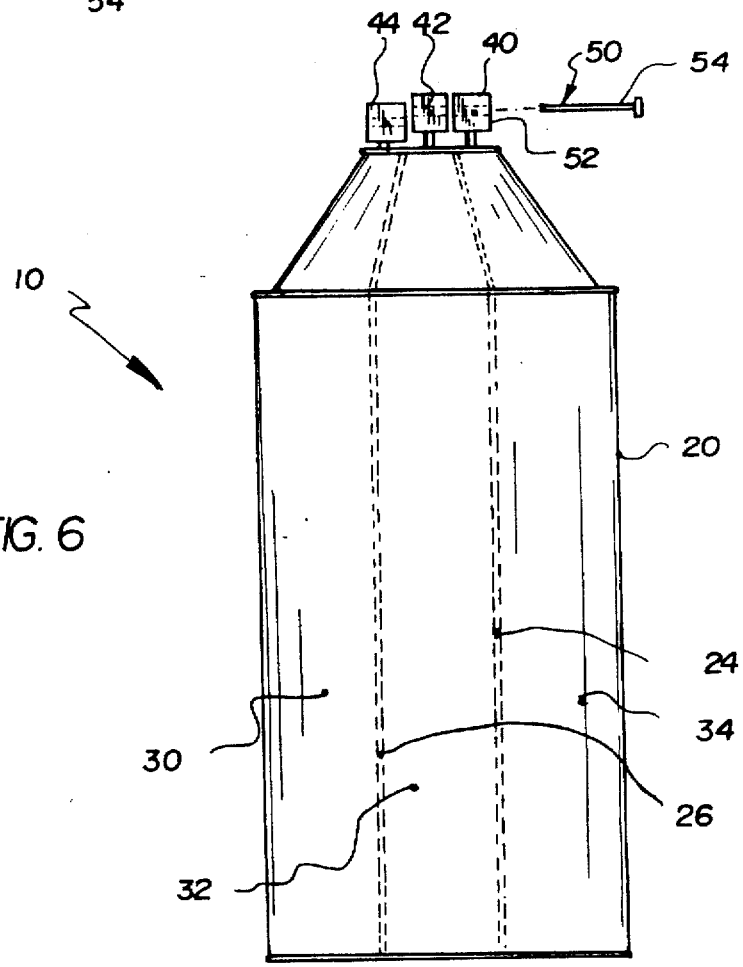
FIG. 6 is an exploded front view of the present invention.

As best shown in FIGS. 3 through 6, a horizontal coupling means 50 removably couples to the spray nozzles 40, 42, 44 to provide activation of all the spray nozzles 40, 42, 44 when a user presses upon a selected spray nozzle 40, 42 or 44. The pin 54 may be removed to allow selective painting with a selected color of paint. The horizontal coupling means 50 has a passage 52 which projects through the spray nozzles 40, 42, 44 horizontally. The passage 52 receives a pin 54 which couples the spray nozzles 40, 42, 44 horizontally providing activation of all the spray nozzles 40, 42, 44 when a user presses upon a selected spray nozzle. A combination of only two selected spray nozzles 40, 42, 44 may be accomplished by inserting said pin 54 only partially into the passage 52. The pin 54 may be removed to allow selective painting with a selected color of paint. The pin 54 preferably has a detent 56 which firmly secures the pin 54 within the passage 52 as shown in FIG. 5 of the drawings.

Figure 2:
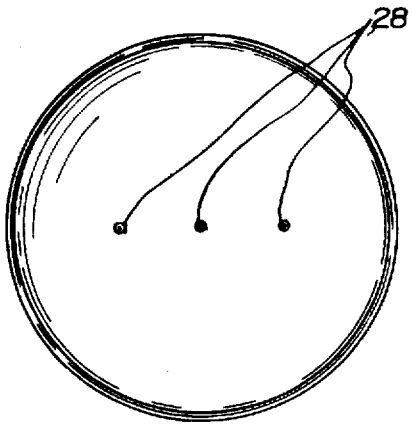
FIG. 2 is a bottom view of the present invention.
Figure 3:
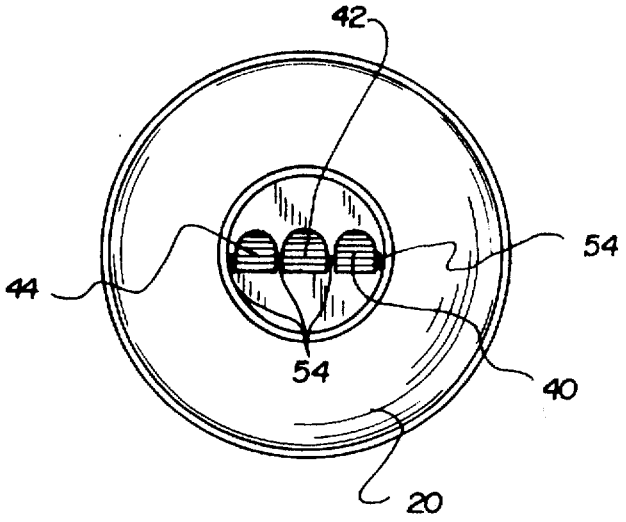
FIG. 3 is a top view of the present invention.
Figure 4:
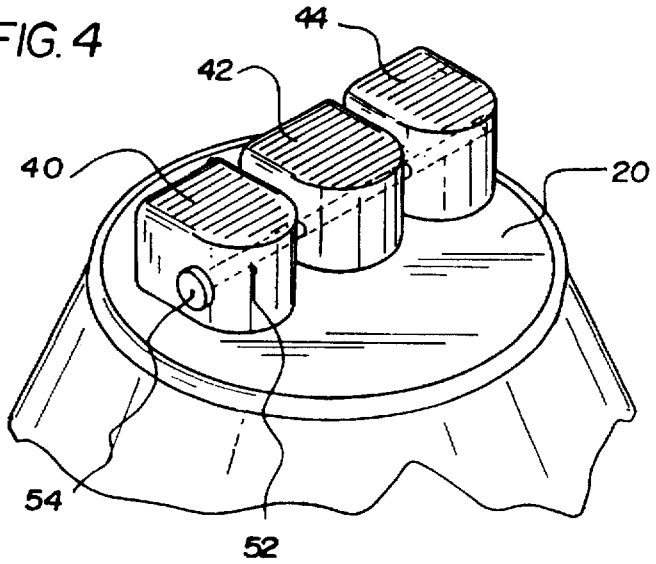
FIG. 4 is a magnified upper perspective view of the plurality of spray nozzles.

As shown in FIG. 2 of the drawings, a corresponding number of fill nozzles 28 preferably project into a bottom surface of the aerosol can 20 which engage the corresponding compartment. The fill nozzles 28 allow filling of the compartments with a desired color of paint by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-compartment aerosol spray container comprising:

an aerosol can having at least one partition projecting vertically thereby forming a plurality of compartments which each store under pressure a desired color of paint:

a plurality of spray nozzles coupled to said aerosol can projecting into said corresponding compartment; and a passage projecting through said spray nozzles horizontally which receives a pin thereby coupling said spray nozzles horizontally providing activation of all said spray nozzles when a user presses upon a selected spray nozzle.

2. The multi-compartment aerosol spray container of claim 1, wherein said pin including a detent which firmly secures said pin within said passage.

3. A multi-compartment aerosol spray container comprising:

an aerosol can having a first partition and a second partition substantially parallel to said first partition thereby forming a first compartment, a second compartment and a third compartment, where said compartments store under pressure a desired color of paint;

a first spray nozzle coupled to said aerosol can projecting into said first compartment;

a second spray nozzle coupled to said aerosol can projecting into said second compartment;

a third spray nozzle coupled to said aerosol can projecting into said third compartment, where said spray nozzles are aligned to form a vertical plane; and a horizontal coupling means removably coupled to said spray nozzles to provide activation of all said spray nozzles when a user presses upon a selected spray nozzle, and where a pin may be removed to allow selective painting with a selected color of paint.

4. The multi-compartment aerosol spray container of claim 3, wherein said horizontal coupling means comprising:

a passage projects through said spray nozzles horizontally, where said passage receives said pin thereby coupling said spray nozzles horizontally providing activation of all said spray nozzles when a user presses upon a selected spray nozzle, and where said pin may be removed to allow selective painting with a selected color of paint.

5. The multi-compartment aerosol spray container of claim 4, wherein said pin including a detent which firmly secures said pin within said passage.

6. The multi-compartment aerosol spray container of claim 5, wherein a corresponding number of fill nozzles project into a bottom surface of said aerosol can which engage said corresponding compartment, thereby allowing filling of said compartments with a desired color of paint.

* * * * *